US005435555A

United States Patent [19]

Fuhrer et al.

[11] Patent Number: 5,435,555

[45] Date of Patent: Jul. 25, 1995

[54] GRAVITY DEFYING GAME OF SKILL AND SPEED

[76] Inventors: David A. Fuhrer, 1332 Berkeley St. #2, Santa Monica, Calif. 90404; Morris Goodman, 2121 W. Main St. #3136, Mesa, Ariz. 85201

[21] Appl. No.: 328,361

[22] Filed: Oct. 25, 1994

[51] Int. Cl.[6] ..... A63F 7/38

[52] U.S. Cl. ..... 273/110

[58] Field of Search ..... 273/109–117, 273/441–443

[56] References Cited

U.S. PATENT DOCUMENTS

| | | | |
|---|---|---|---|
| 507,667 | 10/1893 | Taylor . | |
| 1,154,094 | 9/1915 | Cassard . | |
| 1,291,105 | 1/1919 | Parker | 273/116 X |
| 1,425,793 | 8/1922 | Post | 273/116 |
| 1,544,411 | 6/1925 | Kern . | |
| 1,544,512 | 6/1925 | Weiss . | |
| 1,567,251 | 12/1925 | Ekstein . | |
| 1,595,071 | 8/1926 | Carlson | 273/110 |
| 1,845,473 | 2/1932 | Becker | 273/116 X |
| 2,401,455 | 6/1946 | Bezark . | |
| 2,426,915 | 9/1947 | Bains, Jr. . | |
| 2,782,037 | 2/1957 | Rovira . | |
| 3,879,039 | 4/1975 | Holden . | |
| 3,985,360 | 10/1976 | Meyer . | |
| 4,055,341 | 10/1977 | Martinez | 273/110 X |
| 4,822,045 | 4/1989 | Shoemaker, Jr. . | |
| 5,064,196 | 11/1991 | Gottlieb | 273/110 X |
| 5,066,014 | 11/1991 | Dobson . | |
| 5,242,165 | 9/1993 | Shubert | 273/441 X |
| 5,295,693 | 3/1994 | Dobson | 273/441 |

FOREIGN PATENT DOCUMENTS

| | | | |
|---|---|---|---|
| 767766 | 5/1934 | France | 273/115 |
| 1439218 | 4/1966 | France | 273/110 |
| 16419 | of 1895 | United Kingdom | 273/116 |
| 8303772 | 11/1983 | WIPO | 273/441 |

*Primary Examiner*—Paul E. Shapiro
*Attorney, Agent, or Firm*—Fish & Richardson

[57] ABSTRACT

A game includes a paddle having a first end, a second end positioned vertically higher than the first end, an axis defined from the first end to the second end, a path located on an upper surface of the paddle, and a target, such as a hole, located in the path near the second end of the paddle. The game also includes a movable element, such as a marble, sized to fit within the path and a base rotatably supporting the paddle to permit rotation of the paddle relative to the axis so that rotation of the paddle causes the marble to move along the path from the first end of the paddle to the target. Typically, the game also includes a second paddle rotatably supported by the base and having similar characteristics.

31 Claims, 2 Drawing Sheets

GRAVITY DEFYING GAME OF SKILL AND SPEED

The invention relates generally to games, and, in particular, to a game of skill and speed.

Games of skill using marbles (i.e., glass, plastic or metal spheres) are known. For example, there is a game in which a marble is maneuvered through a maze by rotating the maze relative to two perpendicular axes. In this game, the maze includes several holes that must be avoided to guide the marble from one end of the maze to the other.

In general, the invention features an inclined paddle having a first end positioned vertically lower than a second end. A path located on an upper surface of the paddle runs from the first end of the paddle to a target, such as a hole, located near the second end, and is sized to allow passage of a movable element, such as a marble. A base rotatably supports the paddle to permit rotation of the paddle relative to an axis defined between the first and second ends so that rotation of the paddle causes the marble to move along the path from the first end of the paddle to the hole. Thus, skilled rotation of the paddle moves the marble uphill from the first end to the second end.

Specific embodiments include one or more of the following features. Typically, the axis is defined near the center of the paddle and the path includes portions located on either side of the axis. Thus, as the marble moves along the path, it repeatedly crosses the axis.

An adjustment mechanism coupled between the paddle and the base changes the incline of the paddle by selectively adjusting the vertical position of the second end relative to the first end, and thereby permits variation in the skill required to move the marble along the path (i.e., as the path becomes steeper, it becomes more difficult to move the marble along the path). The adjustment mechanism typically includes a pivot beam, and the paddle includes hinges that snap over pivot points located on the pivot beam. The paddle may also include handles positioned near the first end to ease rotation of the paddle.

The width of the path in the direction perpendicular to the axis typically varies along the axis. For example, the width of the path can continually decrease from the first end of the paddle to the second end. Variation in the width of the path varies the frequency at which the paddle must be rotated to move the marble along the path (i.e., the paddle must be rotated quicker as the width of the path becomes smaller), and thereby increases the difficulty of the game.

The game may also include a collector positioned beneath the hole to collect the marble as it passes through the hole, a marble tray to hold the marble, and a ramp positioned between the collector and the marble tray. The collector, ramp and marble tray typically are coupled to the base.

The game may also include a second paddle having features similar to the first paddle. This second paddle typically includes a second adjustment mechanism so that the two paddles may be set to different inclines. This adjustment has the advantage of allowing players of different skill levels to compete with each other at relatively equal levels.

When two paddles are included, the collector and ramp associated with one paddle may feed into the marble tray associated with the other paddle, and multiple marbles may be used. Thus, when a player successfully moves a marble along the path and into the hole, that marble is deposited into the other player's marble tray.

Typically, the paddles are arranged so that their axes are substantially parallel, and the first end of the first paddle is adjacent to the second end of the second paddle while the second end of the first paddle is adjacent to the first end of the second paddle. This arrangement allows the players to face each other as they play. Generally, the paddles have trapezoidal shapes that decrease in width from the first ends to the second ends, and are arranged next to each other so that the game has a compact size. These trapezoidal shapes also facilitate steadily decreasing the widths of the paths from the first ends to the second ends, which, as discussed above, increases the skill level required to play the game.

During play, each player places a marble in the path of his or her paddle near the first end of the paddle and rotates the paddle about the axis of the paddle until the marble drops through the hole of the paddle. The players repeat this process until one of the players wins by depositing all marbles from the players marble tray and paddle into the other player's marble tray and paddle.

Other features, objects, and advantages of the invention will become apparent from the following detailed description when read in connection with the accompanying drawings, in which.

Figure 1:
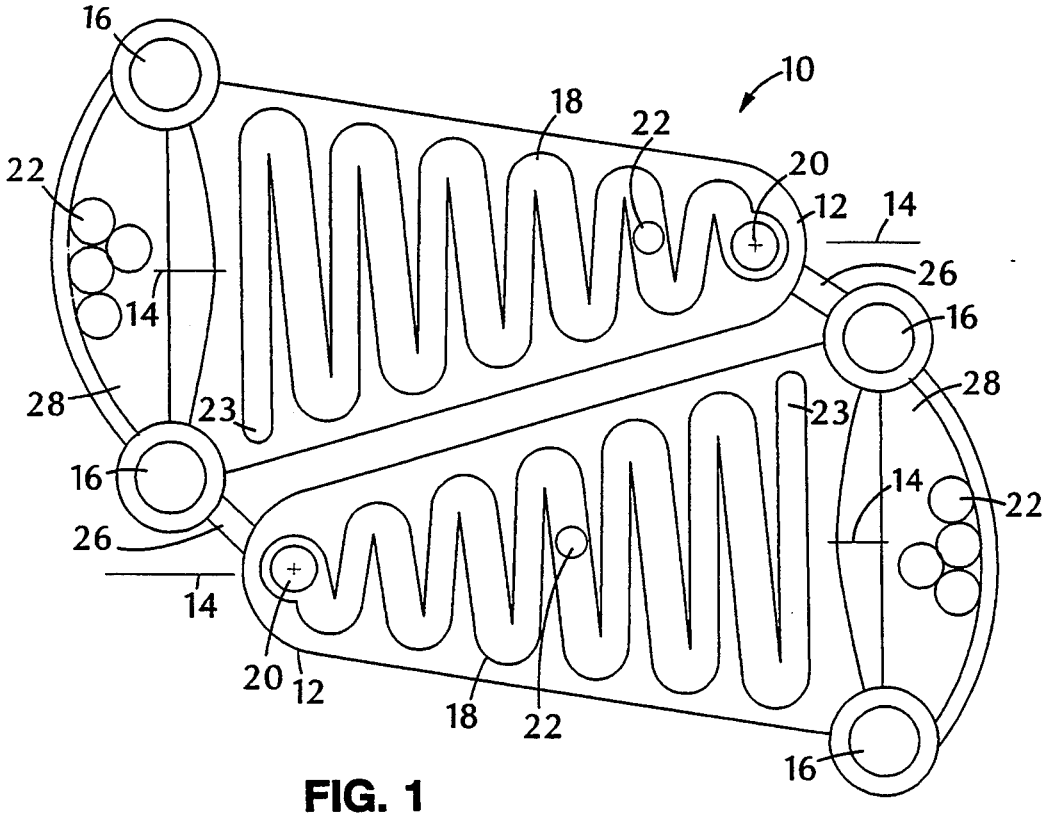
FIG. 1 is a top view of a two player game.

Referring to FIG. 1, a game 10 includes a pair of paddles 12, each of which is inclined along an axis 14 and rotatable about axis 14 by a player grasping handles 16 positioned near the bottom of the paddle 12. A tortuous path 18 that includes a hole 20 near its top is defined in each paddle 12.

During play, a player places a marble 22 at the end 23 of a path 18 and rotates the paddle 12 back and forth about axis 14 so that a marble 22 moves up the inclined paddle along a path 18 until the marble 22 drops through a hole 20. Because rotation of the paddle raises and lowers portions of path 18 (i.e., rotating the paddle to the left lowers the left side of the path), the marble can be caused to move consistently downward along path 18 in directions perpendicular to axis 14 (i.e., when marble 22 is at the left edge of paddle 12, paddle 12 is rotated to the right so that marble 22 moves down to the right side of paddle 12, and, when marble 22 reaches the right edge of paddle 12, paddle 12 is rotated to the left so that marble 22 moves down to the left side of paddle 12). This downward movement of marble 22 in directions perpendicular to axis 14 provides marble 22 with sufficient momentum to move upward along path 18 in a direction parallel to axis 14 and to reach hole 20.

After dropping through hole 20, marble 22 lands in a collector 24 (see FIG. 2) and travels along a ramp 26 to the other player's marble tray 28. A player who successfully removes all marbles 22 from his or her marble tray 28 and paddle 12 by dropping them through hole 20 into the other player's marble tray 28 is declared the winner.

Figure 2:
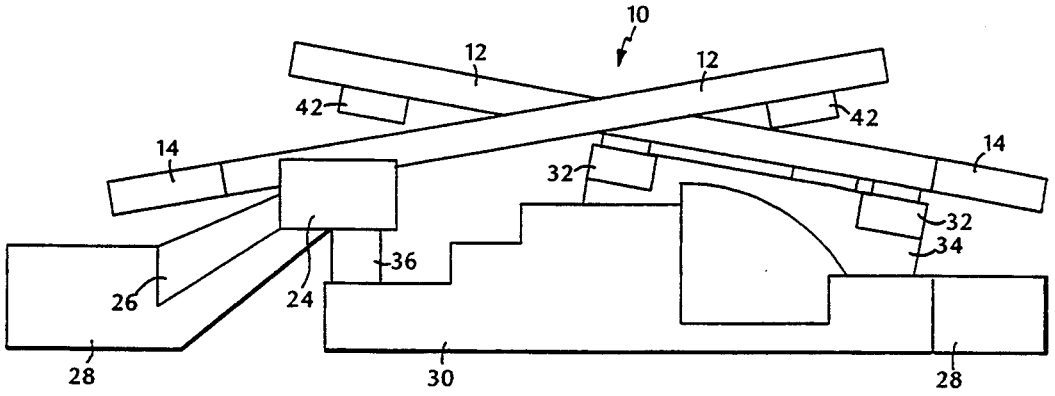
FIG. 2 is a side view of the game of FIG. 1.

Referring to FIG. 2, each marble tray 28 is part of a base 30. A paddle 12 is mounted on each base 30 by two hinges 32 connected to a pivot beam 34 that can be set in one of three positions to permit variation in the incline of each paddle 12. Increasing the incline of a paddle 12 increases the difficulty of moving a marble along path 18 and into hole 20. The inclines 12 are separately adjustable, which permits players of different skill levels to compete against each other. For example, when a highly skilled player is playing a less skilled player, the incline of the paddle 12 used by the highly skilled player can be set to a higher level than that of the paddle 12 used by the less skilled player.

The two paddle units are connected together by pins 36 that extend from the bottom of each collector 24 and fit into slots 38 (see FIG. 3) in the base 30 of the other paddle unit. To reduce wear on marbles 22, each collector 24 includes a foam pad 40 (see FIG. 3) on which the marbles 22 land after falling through a hole 20. Each hole 20 includes an extension 42 that serves to guide a marble 22 falling through hole 20 into a collector 24.

Figure 3:
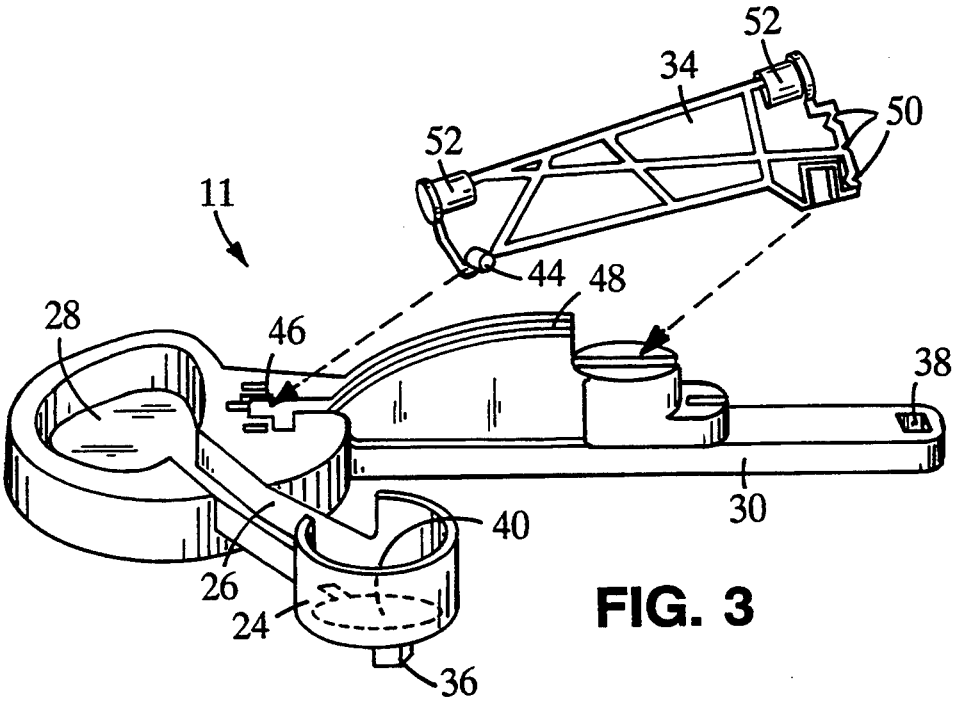
FIGS. 3–4 are perspective assembly views of components of the games of FIGS. 1 and 2.

Referring to FIG. 3, each paddle unit 11 of game 10 is assembled by attaching the pivot beam 34 to the base 30 by inserting rods 44 of pivot beam 34 into a groove 46 of base 30 and the bottom of pivot beam 34 into a slot 48 of base 30. Pivot beam 34 includes three notches 50 that permit adjustment of the incline of the pivot beam. A foam pad 40 is inserted into collector 24 which, along with ramp 26 and marble tray 28, is connected to base 30.

Figure 4:
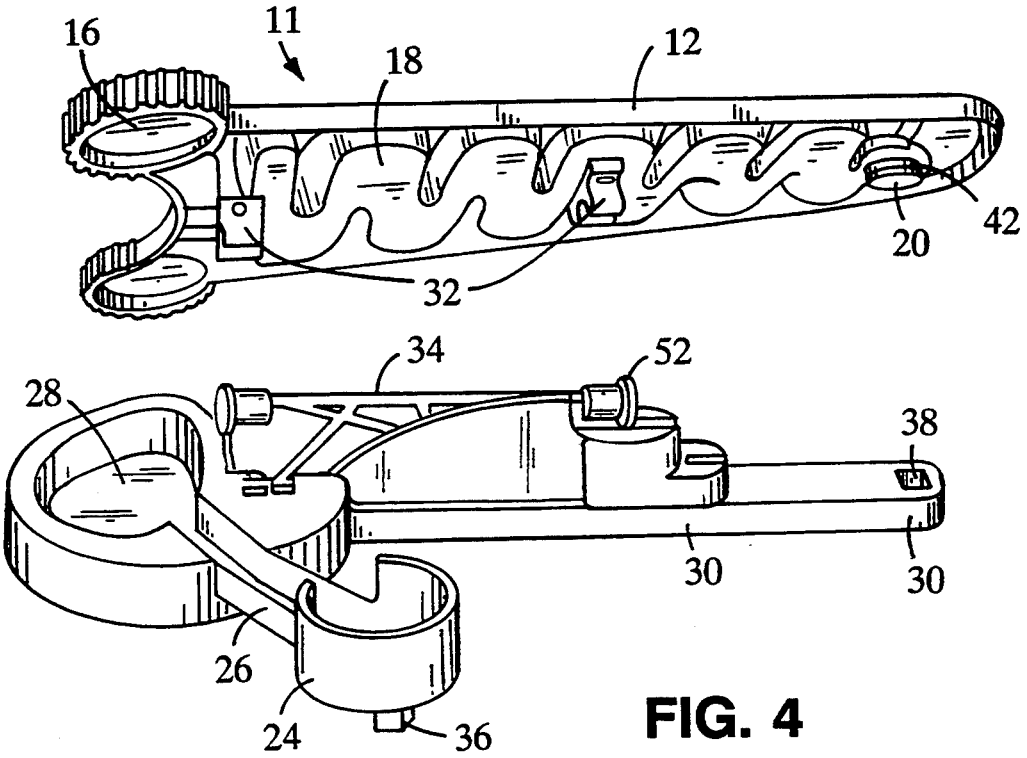

Referring to FIG. 4, once pivot beam 34 has been installed, the paddle 12 is attached by snapping hinges 32 over pivot points 52 on pivot beam 34. Thereafter, the two paddle units 11 are assembled into game 10 by inserting the pin 36 of each paddle unit 11 into the slot 38 of the other paddle unit 11.

Other embodiments are within the following claims. For example, axis 14 could be positioned along the edge of paddle 12. In addition, movable elements other than marbles and targets other than holes could be used.

What is claimed is:

1. A game, comprising:
- a paddle including
  - a first end,
  - a second end positioned vertically higher than the first end,
  - an axis defined from the first end to the second end,
  - a path located on an upper surface of the paddle, and
  - a target located in the path near the second end of the paddle;
- a movable element sized to fit within the path; and
- a base rotatably supporting the paddle to permit rotation of the paddle relative to the axis so that rotation of the paddle causes the movable element to move along the path from the first end of the paddle to the target.

2. The game of claim 1, wherein the axis is defined near the center of the paddle and the path comprises portions located on either side of the axis.

3. The game of claim 1, wherein the width of the path in a direction perpendicular to the axis varies along the length of the axis.

4. The game of claim 1, further comprising an adjustment mechanism coupled between the paddle and the base to selectively adjust the vertical position of the second end relative to the first end.

5. The game of claim 4, wherein the adjustment mechanism comprises a pivot beam having pivot points and the paddle includes hinges having an interference fit with the pivot points.

6. The game of claim 4, wherein the axis is defined near the center of the paddle and the path comprises portions located on either side of the axis.

7. The game of claim 1, wherein the paddle further comprises handles positioned near the first end to facilitate rotation of the-paddle.

8. The game of claim 1, wherein the target is a hole sized to allow passage of the movable element and further comprising a collector positioned beneath the hole to collect the movable element after the movable element passes through the hole.

9. The game of claim 8, further comprising:
- a ramp having an inlet and an outlet, the inlet of the ramp being coupled to the collector; and
- a movable element tray coupled to the outlet of the ramp.

10. The game of claim 9, wherein the collector, ramp and movable element tray are coupled to the base.

11. The game of claim 1, further comprising:
- a second paddle including
  - a second first end,
  - a second second end positioned vertically higher than the second first end,
  - a second axis defined from the second first end to the second second end, the second paddle being rotatable relative to the second axis,
  - a second path located on an upper surface of the second paddle, and
  - a second target located in the second path near the second second end.

12. The game of claim 11, wherein the base rotatably supports the second paddle to permit rotation of the second paddle relative to the second axis when a movable element is positioned on the second path, the rotation of the second paddle causing the movable element to move along the second path from the second first end to the second target.

13. The game of claim 12, wherein
- the axis of the first paddle is defined near the center of the first paddle,
- the path of the first paddle comprises portions located on either side of the axis of the first paddle,
- the second axis is defined near the center of the second paddle, and
- the second path comprises portions located on either side of the second axis.

14. The game of claim 12, wherein the width of the first path in a direction perpendicular to the first axis varies along the length of the first axis and the width of the second path in a direction perpendicular to the second axis varies along the length of the second axis.

15. The game of claim 14, wherein the first and second paddles are generally trapezoidal in shape, with the width of the first paddle decreasing from the first end to the second end, and the width of the second paddle decreasing from the second end to the first end.

16. The game of claim 15, wherein
- the axes of the paddles are generally parallel,
- the first end of the first paddle is positioned adjacent to the second second end, and
- the second end of the first paddle is positioned adjacent to the second first end.

17. The game of claim 14, further comprising a first adjustment mechanism coupled between the first paddle and the base to selectively adjust the vertical position of the second end of the first paddle relative to the first end of the first paddle.

18. The game of claim 17, further comprising a second adjustment mechanism coupled between the second paddle and the base to selectively adjust the vertical position of the second second end relative to the second first end.

19. The game of claim 18, wherein the axis of the first paddle is defined near the center of the first paddle, the path of the first paddle comprises portions located on either side of the axis of the first paddle, the second axis is defined near the center of the second paddle, and the second path comprises portions located on either side of the second axis.

20. The game of claim 19, wherein each of the paddles further comprises handles positioned near the first end of the paddle to facilitate rotation of the paddle.

21. The game of claim 19, wherein each target is a hole sized to allow passage of a movable element and further comprising:

a first collector positioned beneath the hole of the first paddle to collect the movable element after the movable element passes through the hole, and a second collector positioned beneath the hole of the second paddle to collect the movable element after the movable element passes through the hole.

22. The game of claim 21 further comprising:

a first ramp having an inlet and an outlet, the inlet of the ramp being coupled to the first collector;

a first movable element tray coupled to the outlet of the first ramp;

a second ramp having an inlet and an outlet, the inlet of the second ramp being coupled to the second collector; and a second movable element tray coupled to the outlet of the second ramp.

23. The game of claim 22 wherein:

the first movable element tray is positioned near the first end of the second paddle and the second movable element tray is positioned near the first end of the first paddle.

24. The game of claim 23, further comprising multiple movable elements.

25. The game of claim 23, wherein the first paddle, first collector, first ramp, second movable element tray, and a first portion of the base comprise a first unit, the second paddle, second collector, second ramp, first movable element tray, and a second portion of the base comprise a second unit, and the first and second units are coupled together to form the game.

26. A method of using the game of claim 24, comprising:

a first player placing a first movable element from the second movable element tray in the path of the first paddle near the first end of the first paddle;

a second player placing a second movable element from the first movable element tray in the second path near the second first end;

the first player rotating the first paddle about the axis of the first paddle until the first movable element drops through the hole of the first paddle;

the second player rotating the second paddle about the second axis until the second movable element drops through the hole of the second paddle.

27. The method of claim 26, further comprising the first and second players repeating the placing and rotating steps until either no movable elements remain in the second movable element tray or on the first paddle or no movable elements remain in the first movable element tray or on the second paddle.

28. A game, comprising:

a first paddle including a first end, a second end positioned vertically higher than the first end, an axis defined from the first end to the second end, a path located on an upper surface of the first paddle, and a hole located in the path near the second end of the first paddle;

a second paddle including a second first end, a second second end positioned vertically higher than the second first end, a second axis defined from the second first end to the second second end, the second paddle being rotatable relative to the second axis, a second path located on an upper surface of the second paddle, and a second hole located in the second path near the second second end;

marbles sized to fit within the paths; and a base rotatably supporting each paddle to permit rotation of the paddle relative to the axis of the paddle so that rotation of the paddle causes a movable element to move along the path from the first end of the paddle to the target; wherein:

the axis of the first paddle is defined near the center of the first paddle, the path of the first paddle comprises portions located on either side of the axis of the first paddle, the second axis is defined near the center of the second paddle, and the second path comprises portions located on either side of the second axis.

29. The game of claim 28, further comprising a first adjustment mechanism coupled between the first paddle and the base to selectively adjust the vertical position of the second end of the first paddle relative to the first end of the first paddle.

30. The game of claim 29, further comprising a second adjustment mechanism coupled between the second paddle and the base to selectively adjust the vertical position of the second second end relative to the second first end.

31. The game of claim 30, further comprising:

a first collector positioned beneath the hole of the first paddle to collect the marble after the marble passes through the hole;

a second collector positioned beneath the second hole to collect the marble after the marble passes through the second hole;

a first ramp having an inlet and an outlet, the inlet of the ramp being coupled to the first collector;

a first marble tray coupled to the outlet of the first ramp;

a second ramp having an inlet and an outlet, the inlet of the second ramp being coupled to the second collector; and a second marble tray coupled to the outlet of the second ramp; wherein the first marble tray is positioned near the second first end and the second marble tray is positioned near the first end of the first paddle.

* * * * *